US006439300B1

(12) United States Patent
Falta et al.

(10) Patent No.: US 6,439,300 B1
(45) Date of Patent: Aug. 27, 2002

(54) EVAPORATOR WITH ENHANCED CONDENSATE DRAINAGE

(75) Inventors: Steven R. Falta, Ransomville; Mohinder Singh Bhatti, Amherst; Shrikant Mukund Joshi, Williamsville; Gary Scott Vreeland, Medina, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/637,733

(22) Filed: Aug. 11, 2000

Related U.S. Application Data

(60) Provisional application No. 60/172,949, filed on Dec. 21, 1999.

(51) Int. Cl.[7] ..... F28D 1/03; F28F 1/20

(52) U.S. Cl. ..... 165/152

(58) Field of Search ..... 165/152, DIG. 487

(56) References Cited

U.S. PATENT DOCUMENTS

| | | | | |
|---|---|---|---|---|
| 2,002,923 A | | 5/1935 | Palmer | 257/130 |
| 3,923,098 A | | 12/1975 | Ares | 165/111 |
| 4,332,293 A | | 6/1982 | Hiramatsu | 165/153 |
| 4,353,224 A | | 10/1982 | Nonogaki et al. | 62/515 |
| 4,580,624 A | | 4/1986 | Ishida et al. | 165/152 |
| 4,615,384 A | | 10/1986 | Shimada et al. | 165/152 |
| 4,892,143 A | | 1/1990 | Ishii | 165/152 |
| 4,982,579 A | | 1/1991 | Suzuki et al. | 62/515 |
| 5,035,052 A | | 7/1991 | Suzuki et al. | 29/890.046 |
| 5,271,458 A | | 12/1993 | Yamamoto et al. | 165/152 |
| 5,289,874 A | * | 3/1994 | Kadle et al. | 165/152 |
| 5,311,935 A | * | 5/1994 | Yamamoto et al. | 165/152 |
| 5,341,870 A | | 8/1994 | Hughes et al. | 165/110 |
| 5,443,116 A | | 8/1995 | Hayashi et al. | 165/149 |
| 5,669,438 A | | 9/1997 | Beales et al. | 165/152 |
| 5,787,972 A | * | 8/1998 | Beamer et al. | 165/152 |
| 6,161,616 A | * | 12/2000 | Haussmann | 165/176 |

FOREIGN PATENT DOCUMENTS

| | | |
|---|---|---|
| DE | 3606253 A | 11/1986 |
| EP | 0325261 A | 7/1989 |
| EP | 0650023 A | 4/1995 |
| EP | 0962736 A | 12/1999 |
| JP | 54-6659 | 1/1979 |
| JP | 55-6701 | 1/1980 |
| JP | 58-188569 | 12/1983 |
| JP | 59-115279 | 8/1984 |
| JP | 61-128578 | 8/1986 |
| JP | 62-34675 | 2/1987 |
| JP | 62-45580 | 3/1987 |
| JP | 1-81484 | 5/1989 |
| JP | 5-180533 | 7/1993 |

* cited by examiner

*Primary Examiner*—Allen Flanigan
(74) *Attorney, Agent, or Firm*—Patrick M. Griffin

(57) ABSTRACT

An evaporator (10) with opposed pairs of generally vertically oriented flow tube surfaces (14) has corrugated air fins in which the tube surface spacing c, the interior radius r of a crest (20) joining adjacent pairs of fin walls (18), the fin pitch p separating adjacent crests (20), and the length l of louvers (22) cut out of the fin walls (18) bear the following relationship: $0 \leqq r/c \leqq 0.057$, $0.89 \leqq l/c \leqq 1.01$, and $0.29 \leqq p/c \leqq 0.43$. This has been found to substantially improve condensate drainage, while not significantly penalizing heat transfer or air side pressure drop.

2 Claims, 6 Drawing Sheets

EVAPORATOR WITH ENHANCED CONDENSATE DRAINAGE

PRIOR PATENT APPLICATION

This application claims priority of prior provisional patent application Ser. No. 60/172,949 filed Dec. 21, 1999.

TECHNICAL FIELD

This invention relates to air conditioning evaporators in general, and specifically to an improved air fin design that enhances the drainage of condensate.

BACKGROUND OF THE INVENTION

Automotive air conditioning system evaporators are subject to water condensate formation, by virtue of being cold and having humid warm air blown almost continually over them. Water condenses on the tube or plate outer surfaces and fins, partially blocking air flow, increasing thermal resistance, and potentially even shedding or "spitting" liquid water into the ductwork of the system. A screen is often installed downstream of the evaporator to block water shedding, adding considerable expense.

To the extent that condensed water can be forced or encouraged to drain down and out of the evaporator, the above noted problems are reduced. Some obvious and low cost expedients include orienting the evaporator core so that the flat outer plate or tube surfaces are oriented vertically (or nearly so), with open spaces between them at the bottom of the core, so that downward drainage is assisted, and at least, not blocked. Vertical troughs or channels have been formed in the outer plate surfaces, as well, for the same reason.

An inherent problem with vertical plate or tube orientation is that it creates a resultant air fin orientation that is not conducive to condensate drainage. That is, the corrugated fins brazed between the flat plate surfaces are given a nearly horizontal orientation when the plates are arranged vertically, thereby acting as dams to block drainage flow down the plate surfaces. Numerous fin designs have been proposed with notches cut through, or stamped into, the fin corrugation peaks or crests, to thereby provide drains through the fins. Such designs would be considerably more difficult to manufacture, and also remove substantial contact area between the fin crest and plate surface, reducing thermal conduction efficiency between the two.

Fins also typically include banks of thin, angled louvers cut through the fin walls, oriented perpendicular to the air flow, which are intended to break up laminar flow in the air stream, enhancing thermal transfer between the fin wall and the air stream. Louvers are invariably arranged in sets of oppositely sloped pairs or banks, so that the first louver pattern will turn the air stream in one direction, and the next will turn it in the other direction, for an overall sinuous flow pattern. The cutting of the louvers inevitably leaves narrow gaps through the fin walls through which condensate can drain, under the proper conditions.

At least one prior art design claims a connection between the louvers and condensate handling. U.S. Pat. No. 4,580,624 simply proposes to assure that the last, most downstream pattern of louvers on the fin wall be sloped inwardly, toward the interior of the core, rather than sloped toward the exterior. It is claimed that this orientation causes condensate drainage at this downstream point to also flow inward, rather than being blown out into the duct. This is a somewhat odd claim, especially since, with the essentially universal louver pattern of oppositely sloped pairs or banks, the most downstream louvers would be sloped inwardly, anyway, and would inherently do what is claimed. Moreover, a fast air stream moving up through the most downstream louver bank could overwhelm the drainage force, shedding the water regardless, unless the last louver pattern were very steeply sloped. It would be essentially impossible to manufacture a fin in which only the most downstream louver bank was steeply sloped, and putting a very steep louver angle on all louvers in the fin would increase the air side pressure drop considerably.

Another apparent trend in evaporator air fins is the use of corrugated fins in which the fin walls are oriented parallel to each other (or nearly so), in a U shaped corrugation, or in a shallow V with a relatively large radiused crest, rather than a sharper crested V. At least part of the impetus for this trend is the desire for a dense fin pattern or fin pitch, one that puts more fin walls per unit length within the available volume. A wider V shape, in general, would create a less dense pattern of fewer fin walls per unit length, at least for a given radius of the crest. Furthermore, a more rounded, less sharply radiused corrugation crest would be considered desirable in that it provides the only surface area of the fin that directly contacts the plate or tube outer surface. A corrugation crest with a smaller radius (a sharper "V") would provide less mutual contact area. While denser fin patterns theoretically provide more fin-to-air-stream contact, and more fin-to-plate mutual surface contact, which would increase thermal efficiency, the effect on condensate retention has apparently not been closely considered.

An example of an evaporator fin design with parallel walls, and large radiused or U-shaped crests joining the fin walls, is disclosed in U.S. Pat. No. 4,892,143. The design claims lower condensate retention, but claims that such a result is due to a factor that is very much at odds with the actual operation of an evaporator fin of that type, as described further below. The patent claims that by reducing the unlouvered length of the outside of the fin wall and holding it within a small range, that the amount of condensate "trapped" on the exterior of the crest between adjacent fin walls is reduced. In point of fact, with a fin of this design, it is found that water condensate is strongly retained between the facing inner surfaces of the fin walls, on the interior of a fin corrugation, but not on the exterior of the fin crest to any significant extent. It may have been assumed, from observation, that where condensate was not seen, it was somehow being drained or removed, when in fact it had simply not formed in the first instance. In actuality, fin shape design disclosed in the patent, with parallel fin walls and large radiused, U-shaped crests, is the worst performing in terms of retained condensate.

SUMMARY OF THE INVENTION

The invention provides an evaporator with a fin pattern that provides enhanced drainage of water condensate from between the fin walls and out of the evaporator, without degrading the performance of the evaporator otherwise.

In the embodiment disclosed, a laminated type evaporator has a series of spaced tubes, the opposed surfaces of which are separated by a predetermined distance. A corrugated air fin located in the space between opposed plate surfaces is comprised of a series of corrugations, made up of a pair of adjacent fin walls joined at a radiused crest. Each fin wall is pierced by a louver, the length of which is determined by that portion of fin wall not taken up by the radiused crest. Adjacent crests joining adjacent pairs of fin walls are separated by a characteristic spacing or pitch, with smaller pitches yielding higher fin densities, and vice versa. For a given pitch and tube spacing, a volume or cell is defined between the tube surfaces within which each corrugation (pair of fin walls and crest) is located.

According to the invention, the shape of the corrugation within that cell, in terms of radius and relative louver length, is determined and optimized as a function of a series of defined ranges of the ratios of fin pitch, louver length, and crest radius, all to plate spacing. Based on a combination of empirical testing and computer modeling, optimal ranges of those parameters that determine corrugation shape have been determined, as a function of tube spacing, and based on practical considerations of desirable heat flow performance, air pressure drop through the fin, and water retention on and in the fin. For a given tube spacing, the designer can choose a corrugation shape (crest interior radius, fin pitch, and louver length) that will improve condensate drainage significantly, while not significantly degrading the evaporator performance in other areas.

DESCRIPTION OF THE PREFERRED EMBODIMENT

Figure 1:
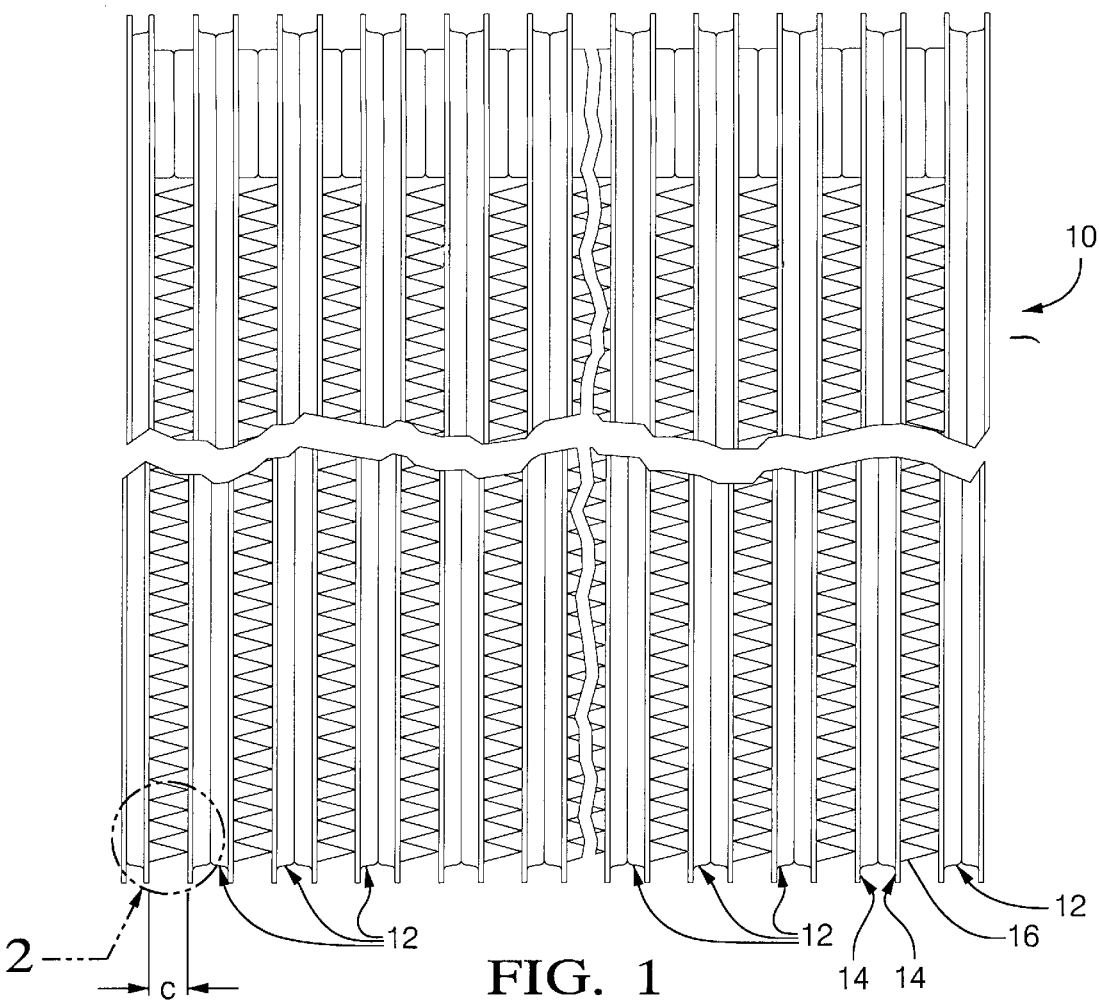
FIG. 1 is a partially broken away view of the front of a typical evaporator core of the laminated type.
Figure 2:
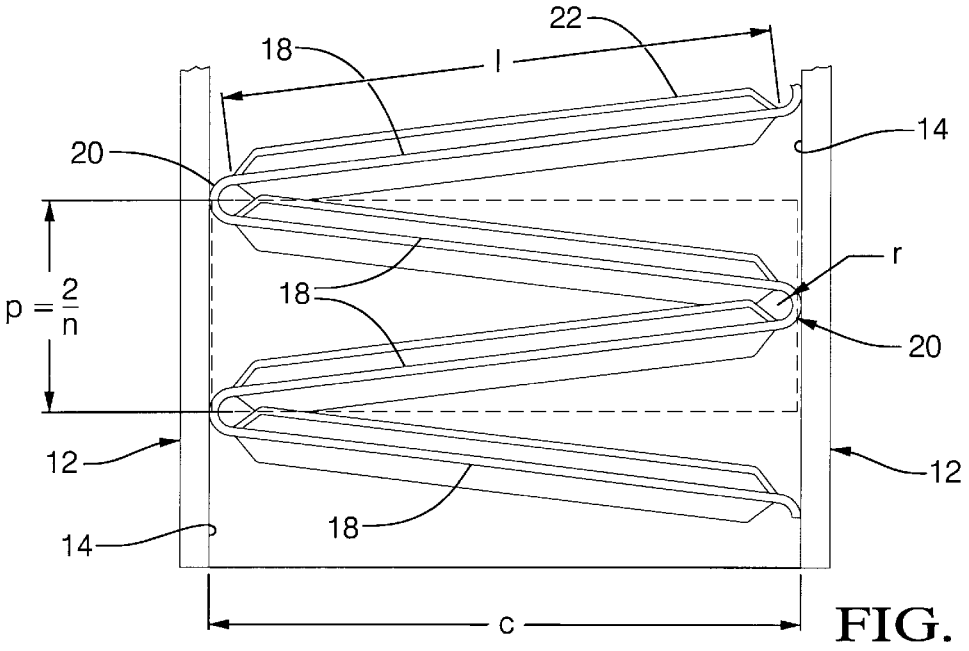
FIG. 2 is an enlarged view of a section of an evaporator core in general showing a complete fin corrugation.

Referring first to FIGS. 1 and 2, a laminated type evaporator, indicated generally at 10, is comprised of a series of spaced refrigerant tubes 12, the opposed outer surfaces 14 of which are separated by a regular, predetermined distance "c". A corrugated air fin, indicated generally at 16, is located in the space between each pair of opposed tube surfaces 14. Fin 16 is comprised of a series of corrugations, each of which, in turn, is comprised of a pair of adjacent fin walls 18, joined at an integral radiused crest 20. The inside or interior radius of each crest 20 is indicated at "r". Each fin wall 18 is pierced by a louver 22, which would have a conventional width and angle relative to fin wall 18. The length "l" of each louver 22 is basically the length of that portion of fin wall 18 not occupied by the radiused crest 20, and the converse is true, as well. Significantly, the basic construction and manufacture of fin 16 according to the invention is conventional, with no holes, or notches to promote drainage, and no differing of varying louver angles, etc, that would impair manufacture. As with any corrugated fin, adjacent crests 20 are separated by a characteristic spacing or pitch, indicated at "p", which has an inverse relationship to the density "n", or number of fin corrugations encountered per unit length of the tube surface 14. That inverse relationship is indicated as p=2/n. For any given pitch "p" and tube spacing "c", a volume or cell is defined between the tube surfaces, indicated by the dotted line rectangle in FIG. 2. According to the invention, a means is provided for optimizing the shape of a corrugation within that available cell.

Figure 3:
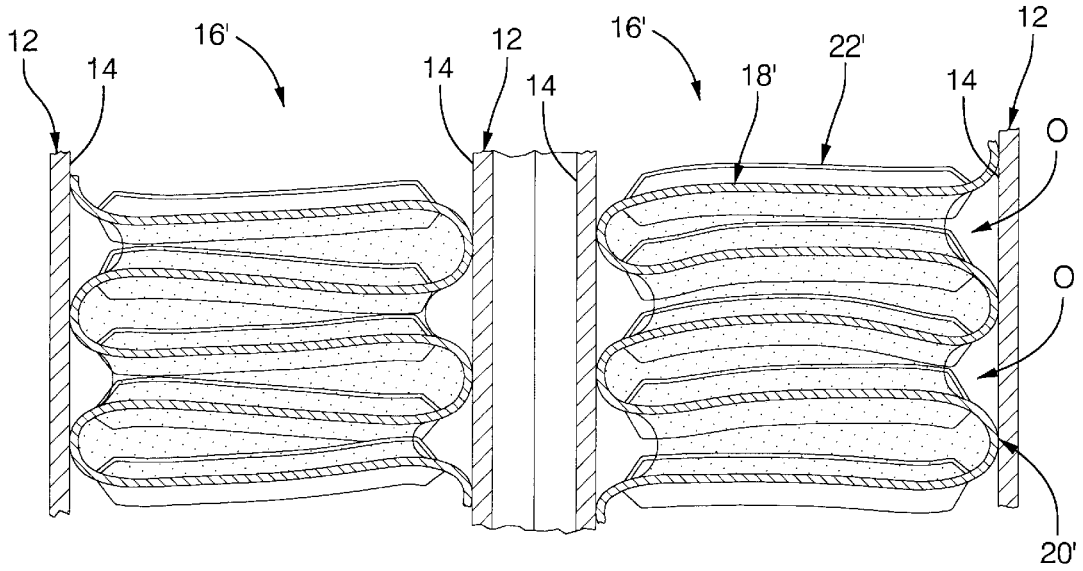
PRIOR ART FIG. 3
FIG. 3 is a view similar to FIG. 2, showing an actual view of an existing or baseline evaporator fin in operation, with retained water condensate formation.

Referring next to FIG. 3, the performance of a currently used, conventional or baseline fin, indicated at 16', is illustrated. Fin 16' is located between the same opposed, flat tube surfaces 14, and has all of the same basic structural features as fin 16 of the invention, so numbered with a prime. Each corrugation of baseline fin 16' is shaped, within the available cell, so as to be more U than V shaped, with a relatively large radiused crest 20'. The fin walls 18' are substantially parallel or, in many cases, actually buckled back in on themselves. The exterior surfaces of each corrugation crest 20' are convex, and thus do not, because of the nature of surface tension forces, act to form or "trap" a water condensate film, in spite of the claims of the patent discussed above. The interior surfaces of the corrugation crests 20', however, are concave, and thus do form and retain water condensate, very readily. The retained condensate grows beyond a film to become a meniscus that bridges the facing fin walls 18', as indicated by the shaded areas. This drawing was produced from a photograph of the actual operation of the evaporator. The result is a series of restricted open areas "O" (areas in cross section, but volumes in fact) bounded by the tube surfaces 14', the exterior surfaces of two adjacent crests 20', and the terminal edge of the retained water meniscus. These areas O are very small relative to the potential open area between the fin walls 18', most of which is blocked. The potential impact on performance is clear. Air passing between the fm walls 18' is restricted, increasing pressure drop and reducing thermal performance. Of course, retained water can lead to the shedding or "spitting" phenomenon referred to above. The fan air forced through the restricted areas O is accelerated, making it even more prone to stripping water out from between the fin walls 18'. This problem has been serious enough to require a screen covering the downstream face of the core, which adds cost and is itself an air flow restriction. Table 1 below gives the relative dimensions and performance parameters for this baseline case.

TABLE 1

Geometric and Performance Information Pertaining to the Baseline Evaporator

| | English Units | Metric Units |
|---|---|---|
| Fin height c | 0.400 in. | 10.2 mm |
| Fin pitch p = 2/n | 0.143 in. | 3.6 mm |
| Louver length l | 0.332 in. | 8.4 mm |
| Fin radius r | 0.036 in. | 0.91 mm |
| Fin density n = 2/p | 14 fins/in. | 5.5 fins/cm |
| Heat transfer rate $q_0$ | 470 Btu/min | 8.26 kW |
| Water retention in operation $m_0$ | 1.56 $lb_m$ | 0.71 kg |
| Airside pressure drop $\Delta P_0$ | 0.47 in. $H_2O$ | 0.12 kPa |

Figure 4:
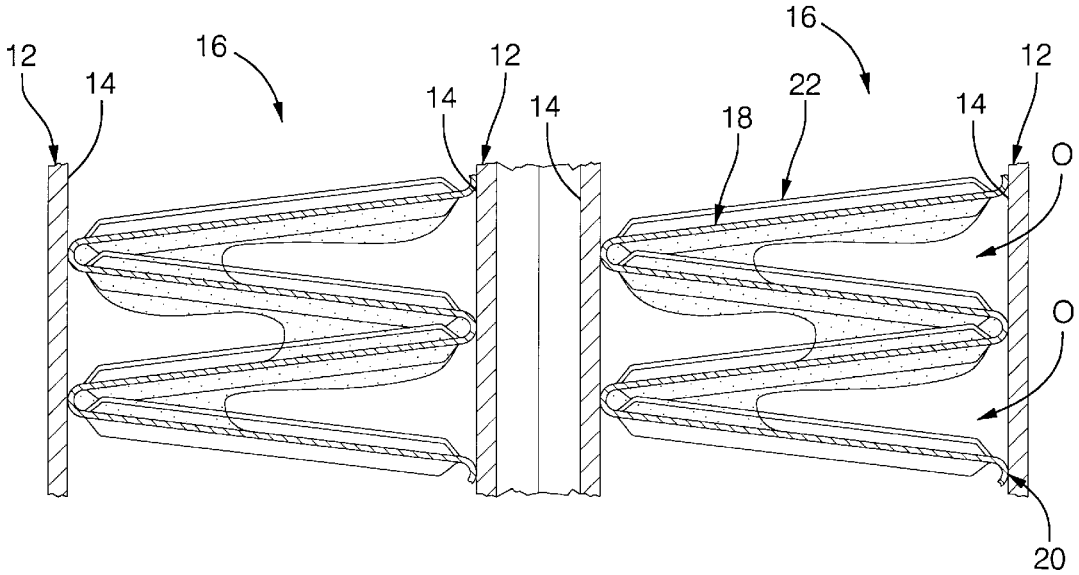
FIG. 4 is a view similar to FIG. 3, showing an actual view of an evaporator fin designed according to the invention, with its reduced and improved water condensate formation.

Referring next to FIG. 4, the performance of a fin 16 made according to the invention is illustrated. The view shows the same evaporator 10, tubes 12, vertically oriented, flat tube surfaces 14, with the same spacing c. Fin 16 has the same pitch as baseline fin 16' described above. As a consequence, the same basic cell within which a corrugation of fin 16 is located is defined. Within that available cell, however, it is evident that the fin 16 is more V shaped than the baseline fin 16', with fin walls 18 that are joined at a sharper, smaller radius crest 20. It is also very evident that the retained water meniscus is much smaller, and the open areas "O" are, consequently, much larger. Before describing the mechanisms that are thought to be at work, a corresponding Table 2 gives the comparative dimensions and measured performance for fin 16:

TABLE 2

Geometric and Performance Information Pertaining to the Test Evaporators

| | English (metric) |
|---|---|
| Fin height c, in. (mm) | 0.400 (10.2) |
| Fin pitch p = 2/n, in. (mm) | 0.143 (3.6) |
| Louver length l, in. (mm) | 0.374 (9.5) |
| Fin radius r, in. (mm) | 0.016 (0.40) |
| Fin density n = 2/p, fins/in. (fins/cm) | 14 (5.5) |
| Heat transfer rate q, Btu/min (kW) | 485 (8.5) |
| Water retention in operation m, $lb_m$ (kg) | 1.10 (0.50) |
| Airside pressure drop ΔP, in $H_2O$ (kPa) | 0.54 (0.13) |

Comparing Tables 1 and 2, a few points are immediately apparent. For an equivalent plate spacing and fin pitch, the heat transfer rate and airside pressure drop are essentially equivalent (the former somewhat better, the latter somewhat worse), but the water retention is significantly improved, by nearly 30%. This is achieved just by the differing corrugation shape within the same available volume or cell, a shape difference reflected in the significantly smaller radius and longer louver length. No major structural change is made to the fin, that is, it has no extra holes or voids added for water drainage, (beyond the attendant louver openings), no special number of, or angle for, or orientation of, the louvers 22. Consequently, manufacture of fin 16 according to the invention can, and would be, done conventionally. But, by the seemingly simple (with hindsight) expedient of shaping the fin as noted, the greatly improved water retention performance is achieved. Not all of the mechanisms at work are perfectly understood, but it is thought that at least two factors are at work, in a synergistic or cooperative fashion. One factor is the sharper radiused crest 20, which results in the more "V shaped" walls 18, which, in turn, tends to pull the meniscus of retained water deeper into the interior of the crest 20, deeper into the "V," in effect. That factor alone, however, would not cause the retained water to drain out any more readily. The second factor is the relatively longer louver 22 (and the relatively longer louver opening that inherently lies next to a longer louver 22.) That provides a drainage path which, advantageously, also extends deeper into the "V," overlapping with the meniscus of water that is continually pulled in. So, the surface tension force pulling the water continually toward the extended drainage path allows an equilibrium to be achieved as water continually drains down, fin to fin, from top to bottom and, eventually, out between the vertically oriented tubes 12. This is an improved drainage equilibrium in which, on balance, significantly less water is retained.

Referring back to FIG. 4, the result of this improved drainage equilibrium is evident. The retained meniscus of water is smaller, so the open areas O are conversely larger. Air flow is, due to that factor alone, less restricted, and the air velocity through the larger open spaces O less, leading to less shedding or "spitting" of the already reduced retained condensate. (Overall airside pressure drop is greater, on balance, because of the longer louvers 22, which increase resistance to air flow). Heat flow performance is improved, since the fin walls 18 are less insulated or "jacketed" by retained condensate. Other advantages of improved condensate drainage include less potential evaporator odor and corrosion, as well as the potential for eliminating add on structures, such a downstream screens, that have been used in the past to block or reduce water shedding. This can represent a significant cost saving.

The invention is broader than just the particular embodiment disclosed in Table 1, of course, and a method is provided by which a designer can achieve a similar result in evaporators with different tube spacings, and achieve it with fins that have different absolute dimensions, but in which the relative dimensions adhere to an optimal range of ratios defined below. Referring next to FIGS. 5 through 8, a series of graphs is presented, which are computer generated depictions of the expected performance of a range of fin shapes and geometries, presented in the form of ratios of parameters that are not normally so considered. For example, in FIGS. 5–7, a ratio of fin radius r to fin height (tube spacing) c is shown at the lower x axis, and the corresponding ratio of louver length l to fin height c is shown at the top x axis. The y axis indicates the ratio of various performance measures to the baseline case (distinguished by the subscript o), such as water retention, heat transfer rate, and pressure drop. The various curves represent the fin geometries at various fin pitches p, again, represented not in absolute terms, but as a ratio of p relative to c. These curves end at a point which represents the limiting factor for l as a ratio of c. That is, for a ratio greater than 1, as the louver 22 becomes very long and essentially as long as the entire fin height, the fin wall 18 could be expected to buckle or curl up, which would be undesirable. Likewise, the curves are not drawn beyond the points where the ratio is so small that the louver 22, in turn, would be too short to be effective in condensate drainage.

Figure 5:
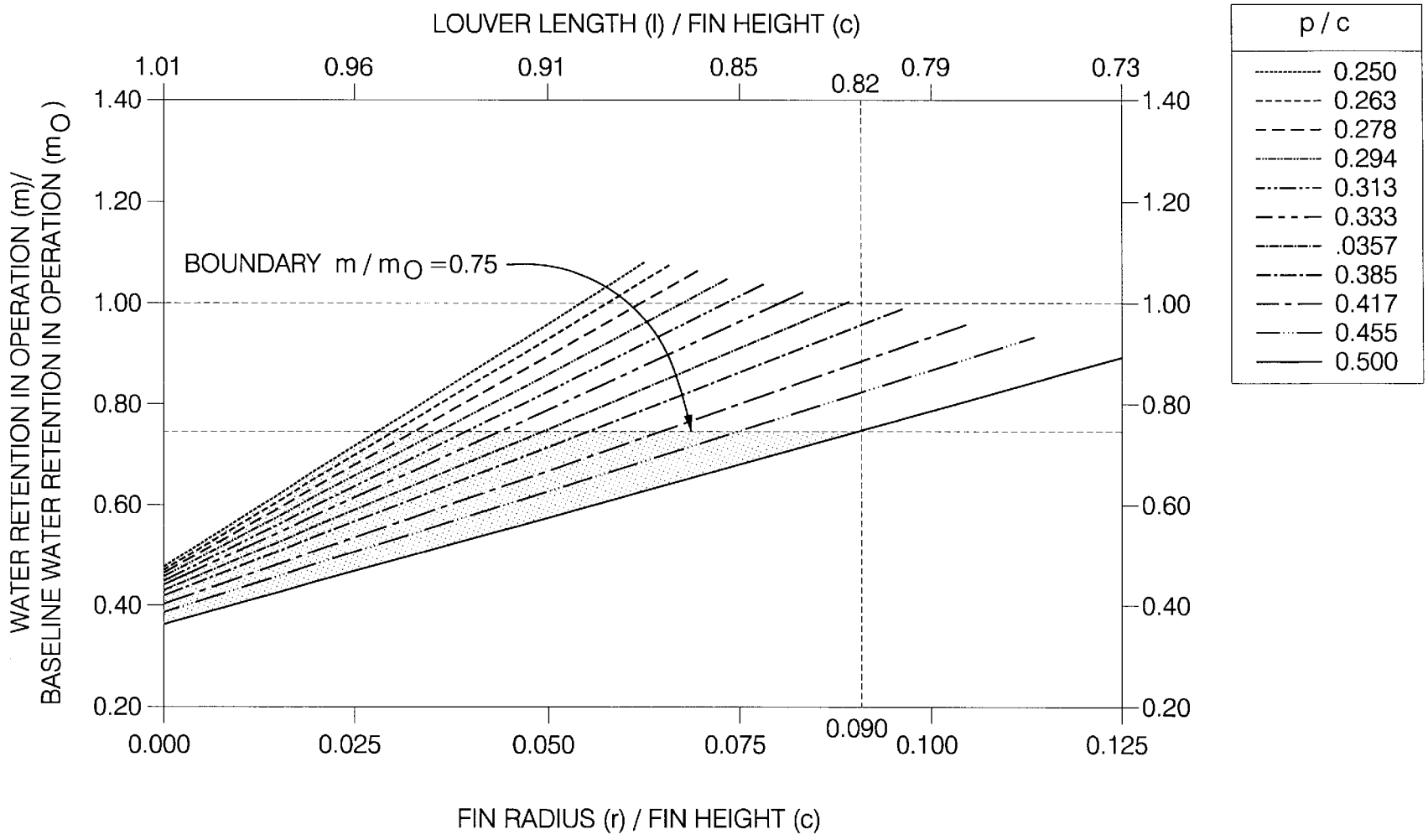
FIG. 5 is a graph showing a comparison of water retention performance for the baseline fin and other fins of varying shape and density.
Figure 6:
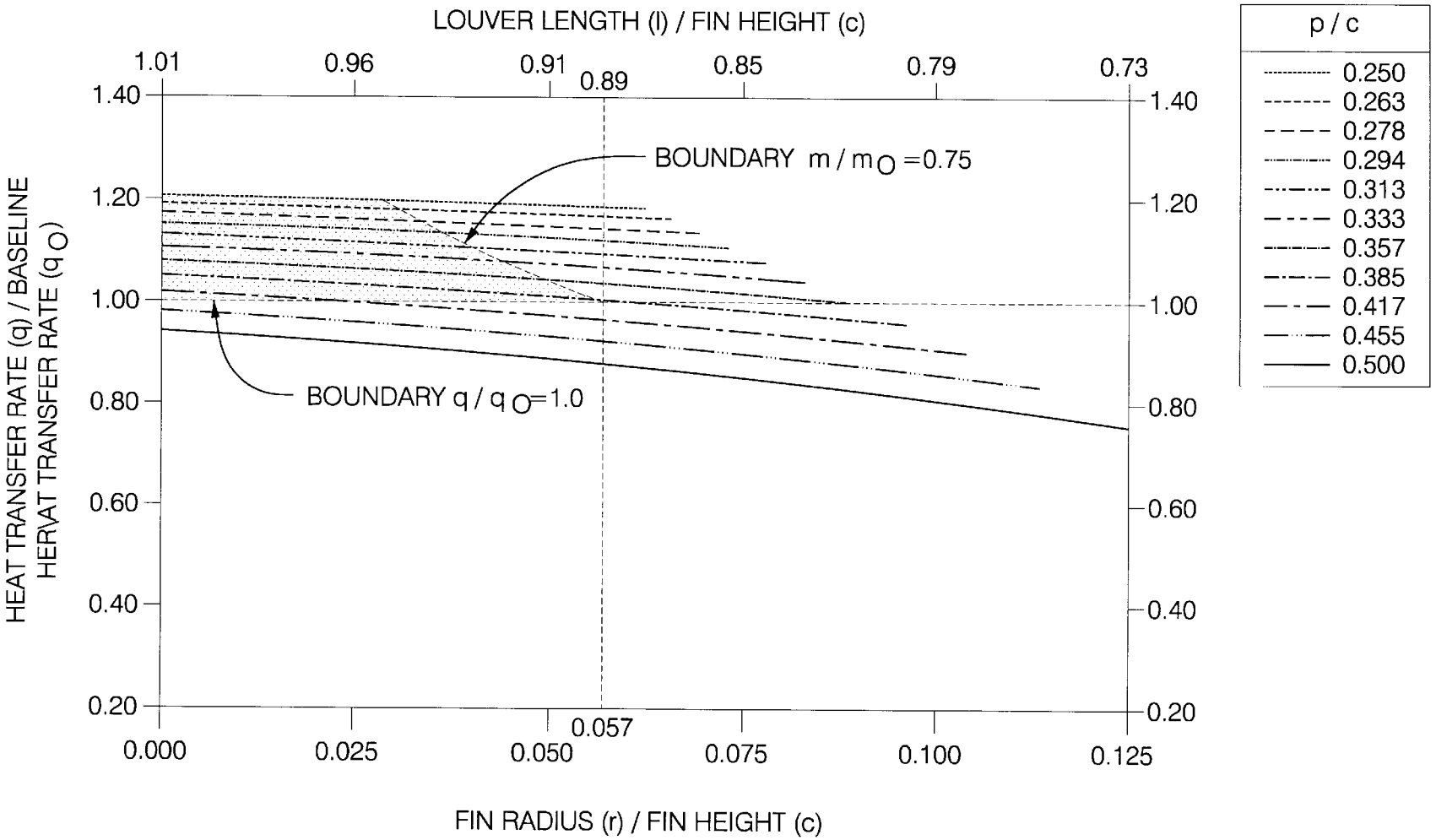
FIG. 6 is a graph showing a comparison of heat transfer performance for the baseline fin and other fins of varying shape and density.
Figure 7:
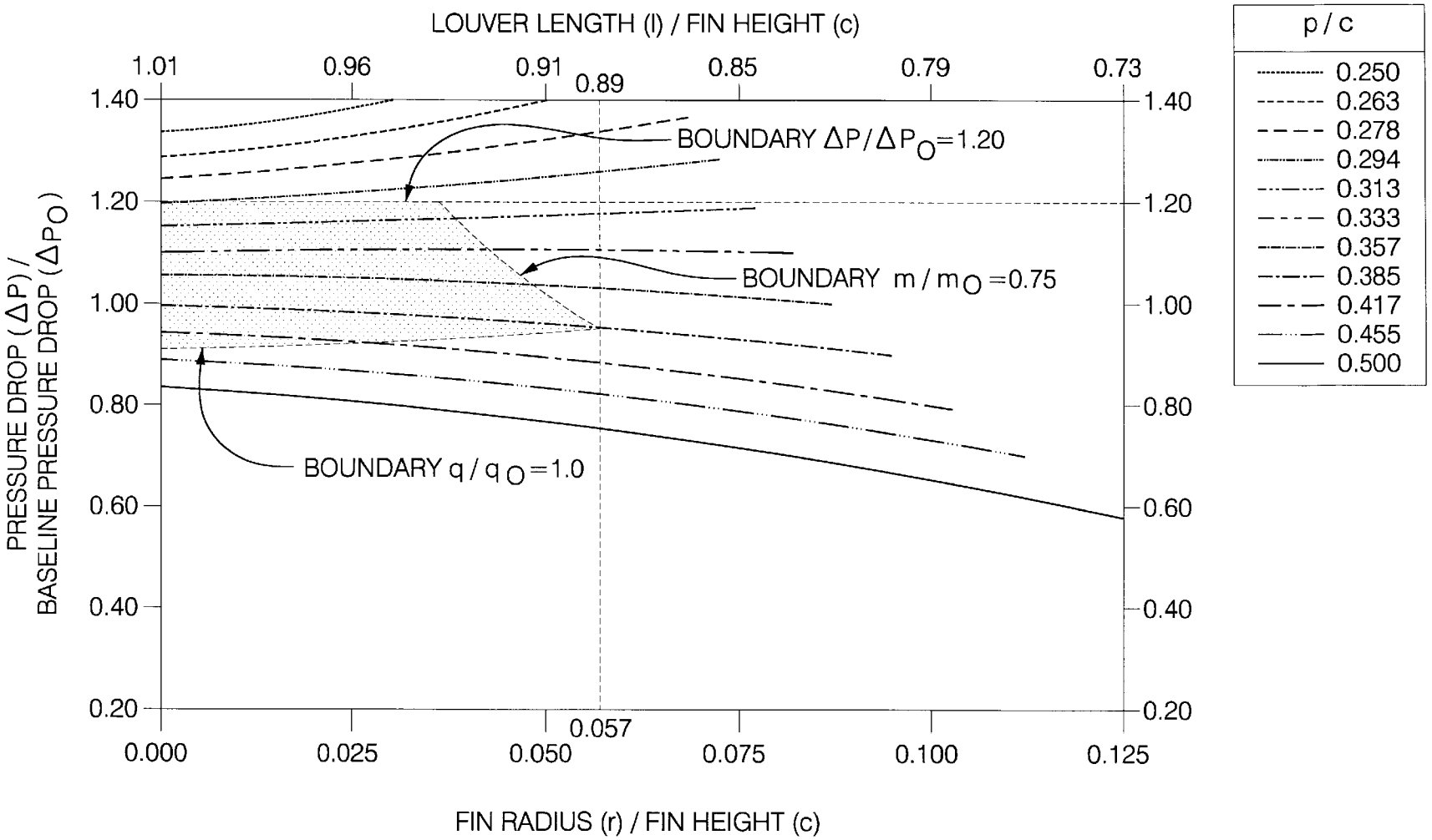
FIG. 7 is a graph showing a comparison of air pressure drop performance for the baseline fin and other fins of varying shape and density.

In determining what is an improved performance, in FIGS. 5 and 7, a ratio of less than 1 is considered better than the baseline case, since it is desired to decrease water retention. For FIG. 6, a ratio of greater than one is an improvement, of course, since it is desired to improve heat transfer (or at least keep it relatively constant). As a practical matter, a hypothetical automotive designer would be satisfied with keeping heat transfer constant, and even increasing the airside pressure drop to an extent, if water retention could be substantially reduced, since it is water retention that is seen as the real problem in this area. The discussion below indicates how an optimal range of the above described ratios can be identified based on these general guidelines. That is, a method is provided by which a designer can, having chosen a given fin height c, in turn determine the other fin dimensions that will yield the desired general result. Stated differently, the designer can, having determined the available room within a cell for a corrugation, then determine the shape of the corrugation within the cell that can be expected to yield the desired result of substantially improved (decreased) water retention, without substantially decreased performance in the areas of heat transfer and air side pressure drop.

Specifically, referring to FIG. 5, it is a given that an evaporator would be considered to be improved if the water retention ratio, $m/m_o$, were less than 1. Referring to the broken horizontal line, corresponding to $m/m_o=1$, and the upward sloping water retention curves, it is apparent that for $m/m_o \leqq 1$, the ranges of the geometric parameters would be:

$$0 \leqq r/c \leqq 0.125$$

$$0.73 \leqq l/c \leqq 1.01$$

$$0.25 \leqq p/c \leqq 0.50$$

This general restriction or condition does not cull anything out of the range of fin dimension possibilities. However, practical experience has shown that to significantly improve the condensate "spitting problem", the ratio should be less than 0.75. Using the broken horizontal line corresponding to $m/m_o=0.75$ in FIG. 5 as the determinate, the ranges of r/c and l/c for $m/m_o \leqq 0.75$ are narrowed giving the following set of ranges of the geometric parameters:

$$0 \leqq r/c \leqq 0.090$$

$$0.82 \leqq l/c \leqq 1.01$$

$$0.25 \leqq p/c \leqq 0.50$$

These ranges of r/c, l/c and p/c corresponding to $m/m_o \leqq 0.75$ are indicated by the shaded area in FIG. 5.

Referring next to FIG. 6, the further constraint of heat transfer rate is illustrated. As noted, FIG. 6 shows variation of the heat transfer rate q with r/c, l/c and p/c. Heat transfer rate q appears as a parameter for the family of the heat transfer rate curves, with the heat transfer rate q is normalized relative to the heat transfer rate $q_o$ for the baseline evaporator given in Table 1. Imposing the additional condition that $q/q_o \geqq 1$, the ranges of the geometric parameters derived from are further narrowed as follows:

$$0 \leqq r/c \leqq 0.057$$

$$0.89 \leqq l/c \leqq 1.01$$

$$0.25 \leqq p/c \leqq 0.43$$

These further narrowed ranges of r/c, l/c and p/c are indicated by the shaded area in FIG. 6.

Referring next to FIG. 7, the consideration of airside pressure drop places yet a further limitation on the ranges of the geometric parameters derived from the water retention and heat transfer constraints defined above. FIG. 7 shows variation of the pressure drop $\Delta P$ with r/c, l/c and p/c, which also appears as a parameter for the family of the pressure drop curves. Also it may be noted that the pressure drop $\Delta P$ is normalized with the pressure drop $\Delta P_o$ for the baseline evaporator given in Table 1. For a high performance evaporator, it is desirable that the pressure drop $\Delta P$ should be less than or equal to the pressure drop in the baseline evaporator $\Delta P_o$. In other words, $\Delta P/\Delta P_o \leqq 1$. As a practical matter, however, a modest pressure drop penalty is acceptable, on the order of approximately 20%, which is less limiting on the range of parametric ratios defined. The horizontal broken line drawn at $\Delta P/\Delta P_o=1.20$ in FIG. 7 completes this final narrowing, and the optimal ranges of the parametric ratios are determined to be:

$$0 \leqq r/c \leqq 0.057$$

$$0.89 \leqq l/c \leqq 1.01$$

$$0.29 \leqq p/c \leqq 0.43$$

This final, further narrowing is also represented by the shaded area in FIG. 7.

Figure 8:
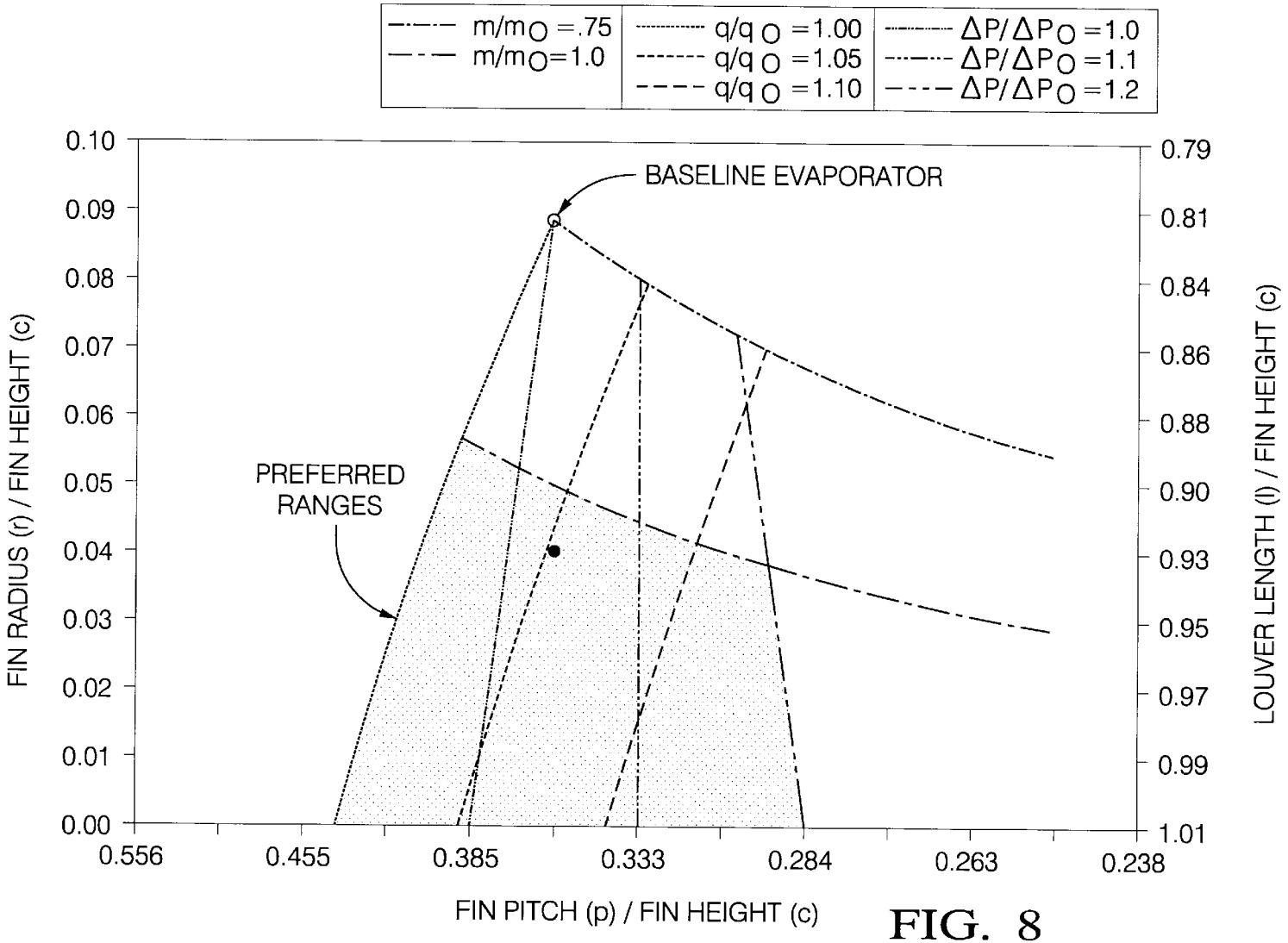
FIG. 8 is a graph that captures the data from FIGS. 5–7 on a single graph to indicate the optimal fin parameter ranges of the invention.

Referring finally to FIG. 8, the three optimal parametric ranges noted above are regraphed on the various axes, and with the three constraints of $q/q_o$, $m/m_o$ and $\Delta P/\Delta P_o$ represented as bounding curves, enclosing a shaded area. The additional constraint that would occur if $\Delta P/\Delta P_o$ were further limited to be either 1.0 or 1.1 is indicated by the additional two broken and nearly vertical lines in the graph. Clearly, the acceptable range of parametric ratios would encompass a much smaller shaded area, with the more restrictive pressure drop constraint. The baseline evaporator is also indicated for purposes of comparison, and the evaporator referred to in Table 2 above is shown as a data point that is within the preferred range.

In conclusion, given the above, a designer can use a predetermined fin height c as a scaling factor, and from that determine a fin pitch, radius and louver length that would fall within the preferred ranges given, and thereby expect a similar performance. That performance would be expected to be characterized by improved (reduced) water retention, with comparable heat transfer, and acceptable air side pressure drop. This would be a relatively simple task, given the guidelines noted, and the fin shape so determined would be no more difficult to manufacture than a conventional fin.

What is claimed is:

1. In an evaporator (10) having substantially parallel, substantially vertically oriented refrigerant flow tubes (12), said tubes having opposed pair of surfaces (14) spaced apart by a distance c, between which tube surfaces (14) corrugated air fins (16) are located, said fin corrugations comprised of adjacent pairs of fin walls (18) joined at integral crests (20) having an interior radius r and a fin pitch p, said fin walls (18) also comprising louvers (22) having a length l, characterized in that, said tube surface spacing c, crest interior radius r, fin pitch p, and fin louver length l have the following relationship:

$$0 \leqq r/c \leqq 0.057$$

$$0.89 \leqq l/c \leqq 1.01$$

$$0.29 \leqq p/c \leqq 0.43,$$

said louver length l further being sufficient that that the ends of said louvers (22) partially overlap when viewed in a direction substantially parallel to said fin crests (20).

2. In an evaporator (10) having substantially parallel, substantially vertically oriented refrigerant flow tubes (12) that carry refrigerant sufficiently cold to cause condensation from humid air forced over said tubes (12) and on surfaces in thermal contact with said tubes (12), said tubes (12) having opposed pair of surfaces (14) spaced apart by a distance c and between which tube surfaces (14) corrugated air fins (16) are located, said fin corrugations comprised of adjacent pairs of fin walls (18) having facing interior surfaces joined at integral crests (20), said crests (20) having an interior surface radius r and a fin pitch p and the exterior surfaces of which crests (20) are in thermal contact with said tube surfaces (14), and in which a meniscus of retained condensed water forms in the interior surface of said crest (20) and bridging between the majority of said fin wall facing interior surfaces to form a restricted open space O bounded by the terminal edge of said meniscus, the exterior surfaces of the crests of adjacent crests (20), and the tube surfaces (14), said fin walls (18) also comprising louvers (22) having a length l and a louver opening adjacent to said louvers (22), characterized in that, said fin crest interior radius r, fin pitch p and tube spacing c have a relative relationship such that said fin walls

(18) form a general V shape with a radius r small enough to create sufficient surface tension force to pull said meniscus of condensed water continually toward the interior surface of said crest (20), and said louver length l is long enough to overlap sufficiently with said meniscus to provide a drainage path that continually drains water from said meniscus, reducing the size thereof and enlarging the size of said open space O, said values of r, p c and l having the following relationship:

$$0 \leqq r/c \leqq 0.057$$

$$0.89 \leqq l/c \leqq 1.01$$

$$0.29 \leqq p/c \leqq 0.43,$$

said louver length l further being sufficient that that the ends of said louvers (22) partially overlap when viewed in a direction substantially parallel to said fin crests (20).

* * * * *